United States Patent [19]

Regina

[11] 4,435,923

[45] Mar. 13, 1984

[54] ABRADING TOOL

[76] Inventor: Ralph Regina, 5471 SW. 16th St., Plantation, Fla. 33317

[21] Appl. No.: 360,736

[22] Filed: Mar. 22, 1982

[51] Int. Cl.[3] ..... B24B 23/04; A47L 13/00

[52] U.S. Cl. ..... 51/170 TL; 51/205 R; 15/235.3; 15/236 R

[58] Field of Search ..... 51/170 TL, 170 R, 204, 51/205 R; 15/236 R, 235.3

[56] References Cited

U.S. PATENT DOCUMENTS

| | | | |
|---|---|---|---|
| 2,020,049 | 11/1935 | Crossman et al. | 51/170 TL |
| 2,280,767 | 4/1942 | Ferragano | 51/205 R |
| 2,493,226 | 1/1950 | Cole | 51/170 TL |
| 3,109,189 | 11/1963 | Eldridge, Jr. | 15/105.5 |
| 3,564,778 | 2/1971 | Haas | 51/170 TL |
| 4,064,588 | 12/1977 | Cooper | 15/236 R |
| 4,155,142 | 5/1979 | Demetriadis | 15/236 C |

*Primary Examiner*—Roscoe V. Parker

*Attorney, Agent, or Firm*—Oltman and Flynn

[57] ABSTRACT

For cleaning or finishing the exposed grout between neighboring tiles in a tiled wall or floor, the present tool has a base with an attached handle on one side and an elongated recess on the opposite sides which receives opposed clamping plates holding an abrasive pad between them which extends beyond that side of the base. The clamping plates are spring-mounted in a holder which may be reciprocated by an electric motor detachably mounted on the base or may be locked against reciprocation when the motor is detached.

12 Claims, 14 Drawing Figures

FIG. 1
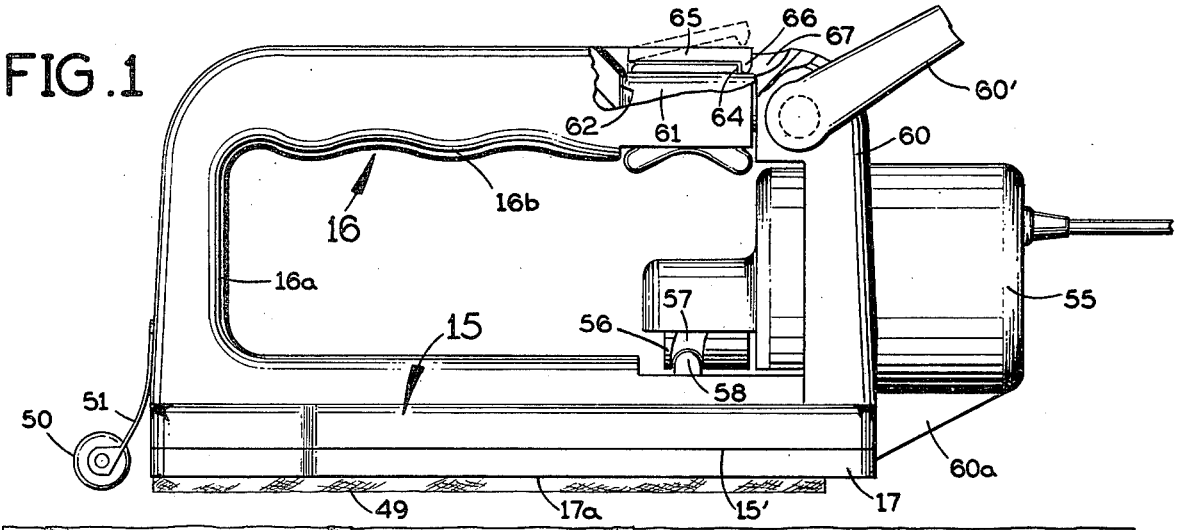
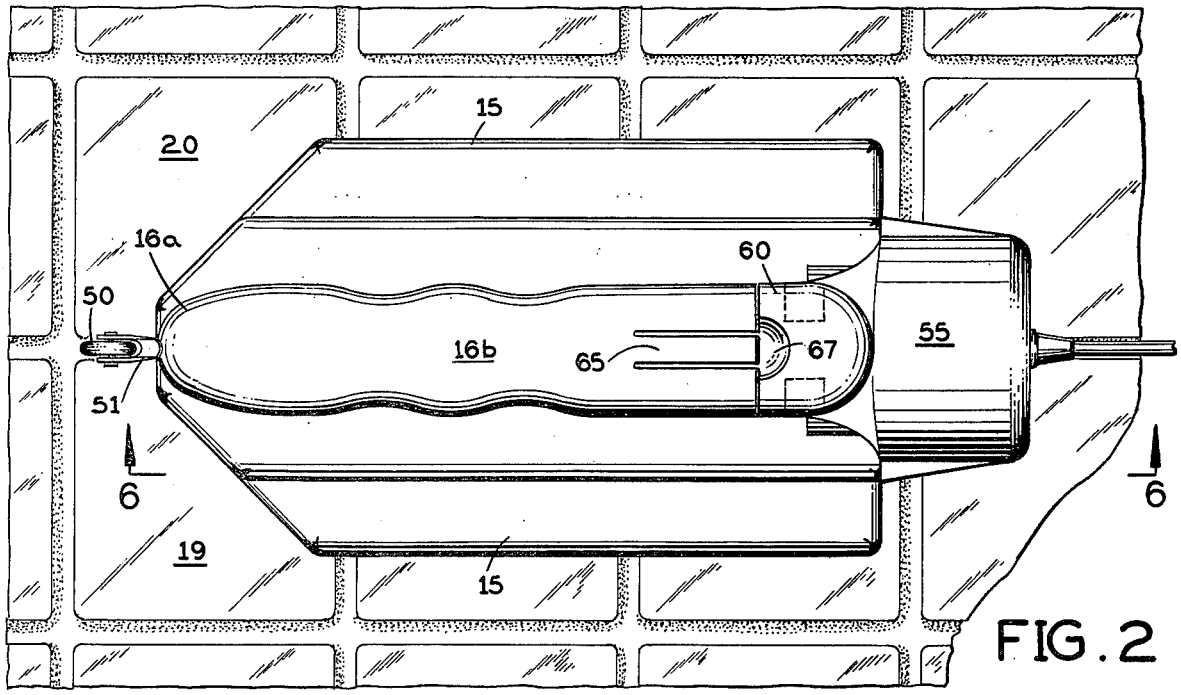
FIG. 2
FIG. 3
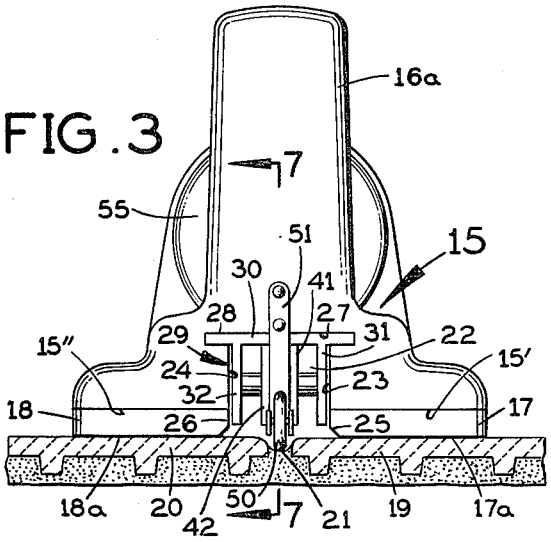
FIG. 4
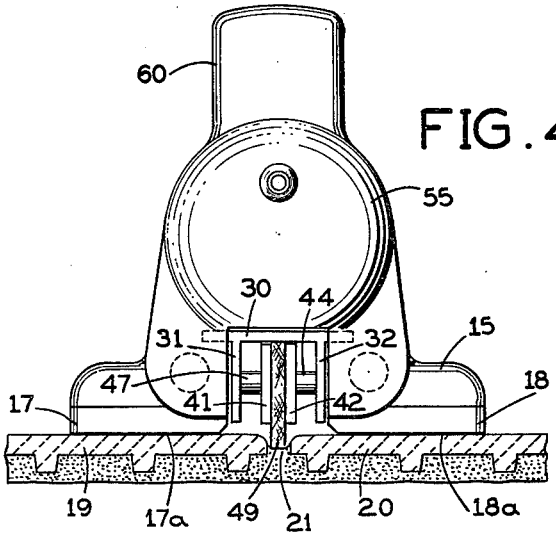

FIG. 5
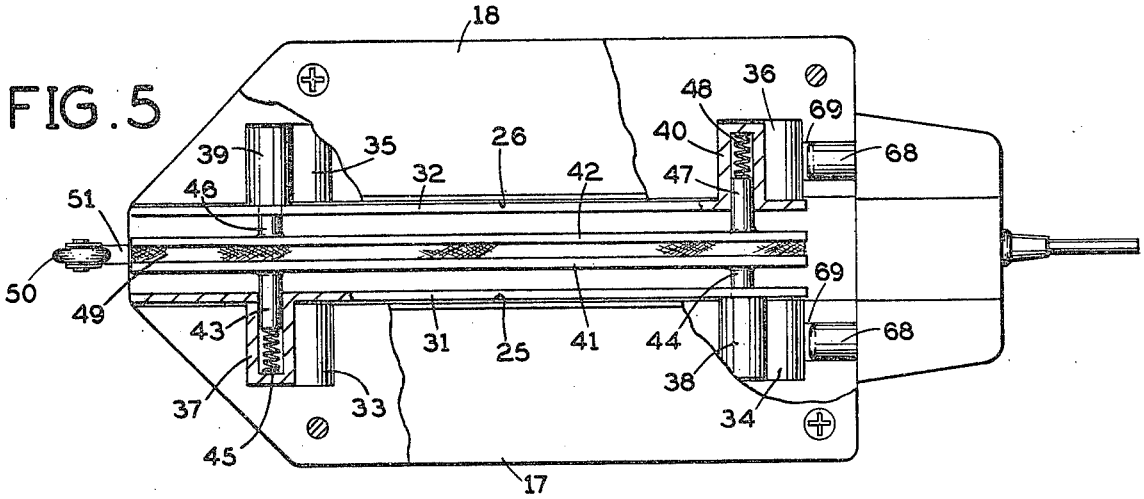
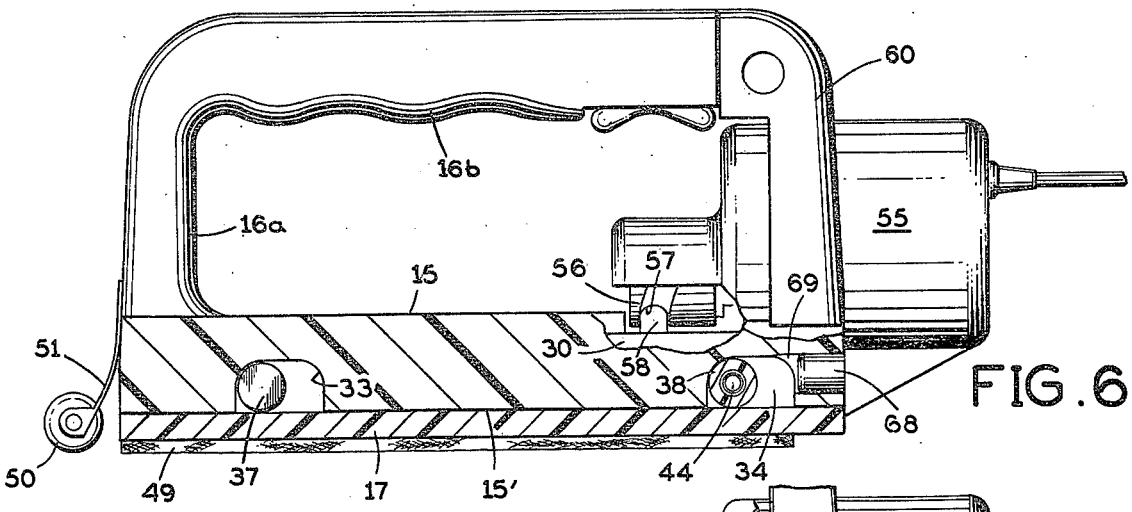
FIG. 6
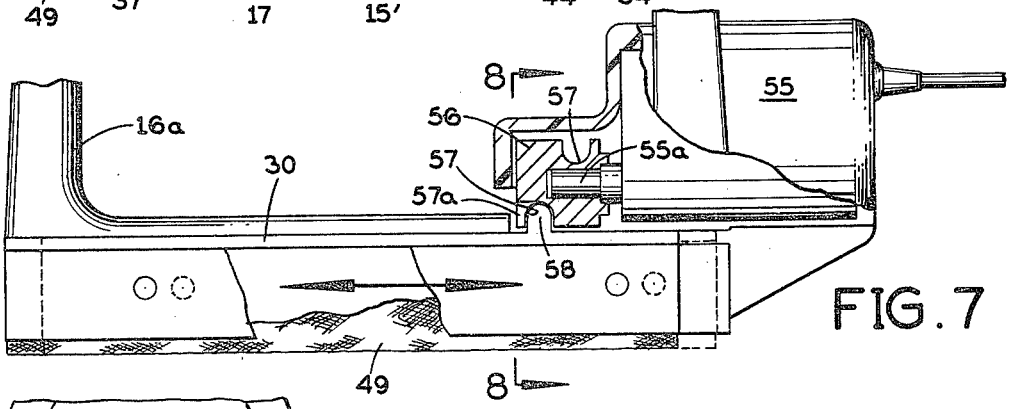
FIG. 7
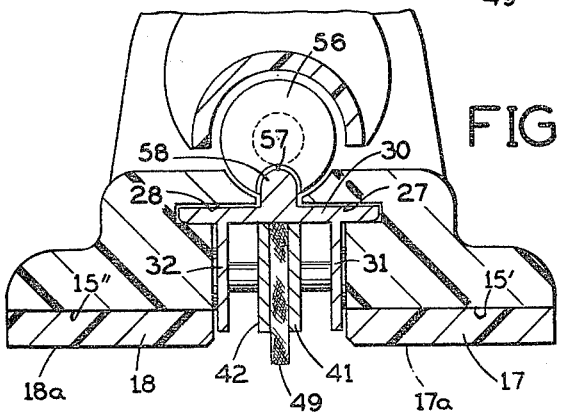
FIG. 8
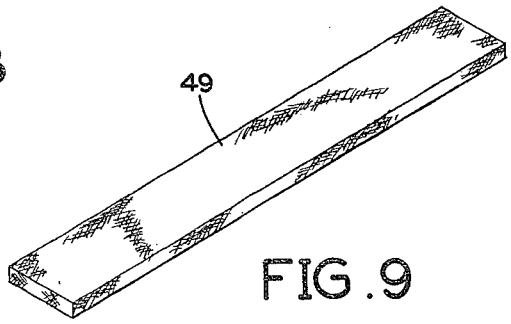
FIG. 9

ABRADING TOOL

SUMMARY OF THE INVENTION

This invention relates to an abrading tool for finishing or cleaning the exposed grout between neighboring tiles in a tiled wall or floor.

In accordance with the present invention, an abrading tool having a base and a handle on one side of the base is formed with a longitudinal recess in the opposite side of the base which receives a pair of clamping members for holding an abrasive pad sandwiched between them and projecting beyond this side of the base. Preferably, the clamping members are mounted in a holder which may be reciprocated lengthwise of the base of the tool by an electric motor mounted on the back end of the tool. Preferably, also, the motor is detachable from the tool and a locking element on the base is engageable with the holder to prevent it from reciprocating along the base of the tool when the drive motor is disconnected. Thus, the abrasive pad can be motor-driven when the drive motor is on the tool or it can be reciprocated manually in unison with the rest of the tool when the motor is detached.

A principal object of this invention is to provide a novel and improved abrading tool for finishing or cleaning the exposed grout between neighboring tiles in a tiled wall or floor.

Another object of this invention is to provide such a tool which may be either motor-operated or hand-operated.

Another object of this invention is to provide a novel abrading tool having a detachable drive motor.

Further objects and advantages of this invention will be apparent from the following detailed description of certain presently preferred embodiments shown in the accompanying drawings.

DESCRIPTION OF THE DRAWINGS

FIG. 1 is a side elevation of a first embodiment of the present abrading tool with the drive motor attached and with parts broken away for clarity;

FIG. 2 is a plan view of this tool operatively engaging a tiled floor or wall;

FIG. 3 is a front elevation of the FIG. 1 tool engaging the tiled floor or wall;

FIG. 4 is a rear elevation of the tool engaging the tiled floor or wall;

FIG. 5 is a bottom plan view of the tool, with parts broken away for clarity;

FIG. 6 is a longitudinal section taken along the line 6—6 in FIG. 2;

FIG. 7 is a longitudinal section taken along the line 7—7 in FIG. 3;

FIG. 8 is a cross-section taken along the line 8—8 in FIG. 7;

FIG. 9 is a perspective view of an abrading pad used in the present tool;

DETAILED DESCRIPTION

Figure 10:
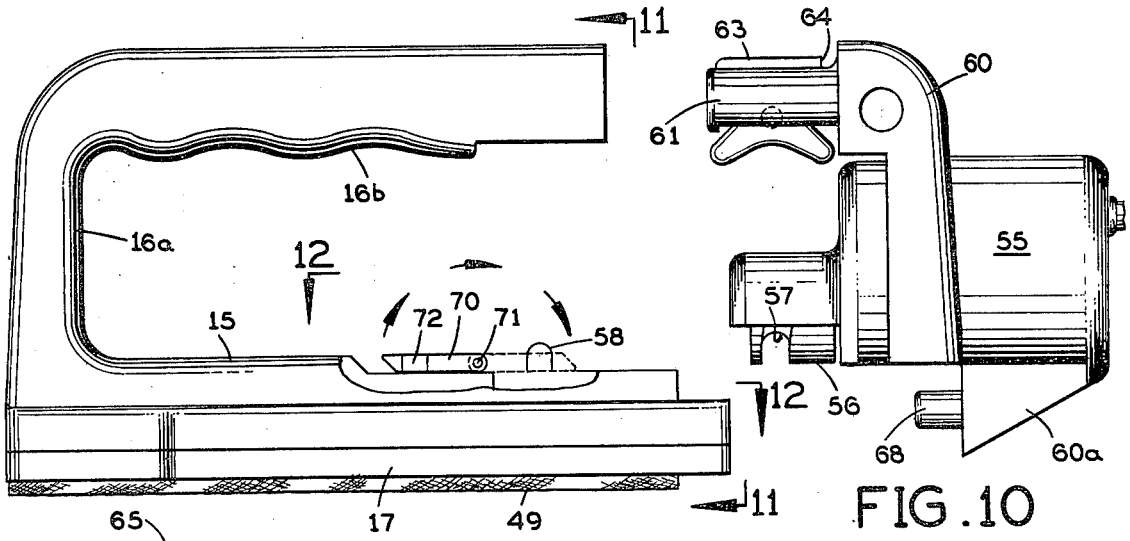
FIG. 10 is a side elevation showing the drive motor detached from the abrading tool.

Before explaining the disclosed embodiments of the present invention in detail, it it to be understood that the invention is not limited in its application to the details of the particular arrangements shown, since the invention is capable of other embodiments. Also, the terminology used herein is for the purpose of description and not of limitation.

Referring first to FIG. 1, the abrading tool shown there comprises a base segment 15 and a generally L-shaped handle 16. The handle has a leg **16*a* connected at one of its ends to one end of the base segment 15 and extending perpendicularly away from the base on one side. The handle also has a hand grip segment 16*b* connected to the opposite end of leg 16*a* and extending from it parallel to the base segment 15. As shown in FIG. 3, the base segment 15 extends laterally on opposite sides of the handle and presents relatively wide, flat faces 15' and 15'' at the bottom in FIG. 3. Preferably, the base segment 15 and the entire handle 16 are formed as a one-piece body of suitable plastic material. The base of the tool also includes a pair of flat, rigid plates 17 and 18 which are bolted or otherwise attached to the flat faces 15' and 15'' of the base segment 15. The base plates 17 and 18 present exposed flat faces 17*a* and 18*a* (at the bottom in FIG. 3) which are co-planar with each other and are exposed for sliding engagement with floor or wall tiles 19 and 20 located on opposite sides of an exposed grout seam 21 which is to be abraded by the present tool. As shown for the base plate 17 in FIG. 1, both base plates 17 and 18 extend the entire length of the base segment 15, which is longer than the hand grip segment 16*b*** of the handle.

The base segment 15 and the laterally spaced base plates 17 and 18 define a longitudinal recess 22 (FIG. 3) which is open at the opposite ends of the base from the handle 16 and extends along the entire length of the base. The base segment 15 defines opposite, flat, parallel side walls 23 and 24 of this recess. The neighboring edges 25 and 26 of the base plates 17 and 18, respectively, are extensions of the side walls 23 and 24 and they are chamfered adjacent the exposed faces **17*a* and 18*a* of the base plates. At the inner ends of its walls 23 and 24 (the upper ends in FIG. 3) the recess 22 has lateral extensions 27 and 28**.

A rigid, generally channel-shaped holder 29 is slidably received in the recess 22. This holder has a flat inner end segment 30, which is slidably received in the lateral extensions 27 and 28 of the recess 22, and opposite side segments 31 and 32, which extend perpendicular to the inner end segment 30 next to the side faces 23 and 24 of recess 22.

As shown in FIGS. 5 and 6, the base segment 15 is formed with longitudinally spaced transverse recesses 33 and 34 which extend laterally outward from the side wall 23 of the longitudinal recess 22. These transverse recesses are located immediately adjacent the base plates 17 and 18, respectively. At the opposite side of the longitudinal recess 22 the base segment 15 is formed with similar transverse recesses 35 and 36 (FIG. 5) extending laterally outward from the side wall 24 of recess 22 at the same locations longitudinally of the base as recesses 33 and 34, respectively.

Holder 29 has cylindrical projections 37, 38, 39 and 40 which are slidably received in transverse recesses 33, 34, 35 and 36, respectively. Each of these projections on holder 29 is open at its laterally inward end, i.e., at the side segment 31 or 32 of the holder, and is closed at its laterally outward end. Each transverse recess 33, 34, 35 and 36 in the base of the tool is substantially longer lengthwise of the tool than the diameter of the corresponding projection 37, 38, 39 or 40 on holder 29 to permit limited reciprocation of the holder longitudinally of the tool base. The depth of each recess 33, 34, 35 and 36 away from the corresponding base plate 17 or 18 (vertically in FIG. 6) is just slightly larger than the diameter of the corresponding projection 37, 38, 39 or 40, so that each projection has a sliding fit in the recess.

Two elongated, flat, rectangular clamping plates 41 and 42 (FIGS. 5 and 8) are located inside the holder 29 in confronting relationship to each other. As shown in FIG. 5, clamping plate 41 carries a pair of laterally outwardly projecting pins 43 and 44 which are slidably received, respectively, in the transverse projections 37 and 38 on holder 29. Coil springs 45 are engaged under compression between the closed outer ends of the holder projections 37 and 38 and the outer ends of pins 43 and 44. These spring bias the clamping plate 41 laterally inward. The other clamping plate 42 carries a pair of laterally outwardly projecting pins 46 and 47 which are slidably received, respectively, in the projections 39 and 40 on holder 29. Coil springs 48 are engaged under compression between the closed outer ends of these holder projections and the outer ends of pins 46 and 47. These springs bias the clamping plate 42 laterally inward toward the clamping plate 41.

An elongated, thin, rectangular pad 49 of suitable abrasive material (FIG. 9) is sandwiched between clamping plates 41 and 42, as shown in FIG. 8. The springs 45 and 48 hold the clamping plates 41 and 42 tightly against the flat opposite major faces of the abrading pad 49. In FIG. 8 the inner edge of the abrading pad engages the inner end plate 30 of holder 29 and the outer edge of the abrading pad is located beyond the exposed, tile-engaging faces 17*a* and 18*a* of the base plates 17 and 18 on the tool. As shown in FIG. 4, when the base plates 17 and 18 slidably engage tiles 19 and 20, the abrading pad 49 engages the bead of grout 21 between these tiles.

A guide roller 50 (FIG. 1) is carried by a flexible spring metal arm 51 attached to the front of handle segment 16*a*. As shown in FIGS. 2 and 3, this roller engages the grouted groove between tiles 19 and 20 at the front of the tool.

Preferably, the tool has an electric motor for reciprocating the holder 29, clamping plates 41 and 42, and abrading pad 49 as a unit longitudinally of the base of the tool.

Referring to FIG. 7, this motor 55 has a rotary output shaft 55*a* which drives a generally cylindrical cam 56 formed with an endless groove 57 in its periphery which extends in a spiral circumferentially of the cam and a straight return segment connecting the opposite ends of the spiral. The holder 29 in the tool has a cam follower 58 extending perpendicular to its inner end plate 30 and slidably received in the groove 57 in the motor-driven cam 56. The rotation of the motor-driven cam 56 causes the holder 29 to be reciprocated longitudinally of the tool as the follower 58 on the holder rides along the continuous groove 57 in the cam.

Figure 11:
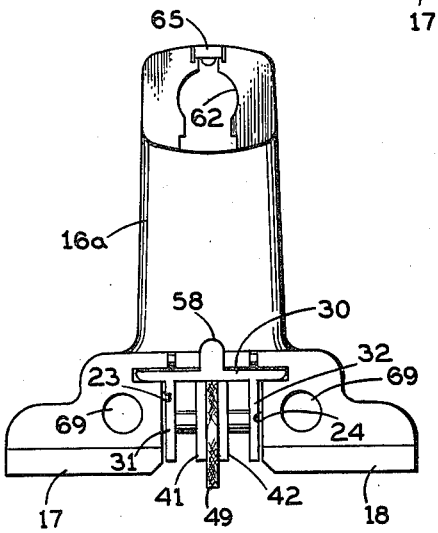
FIG. 11 is a view, taken along the line 11—11 in FIG. 10, showing a rear elevation of the tool with the motor detached.
Figure 12:
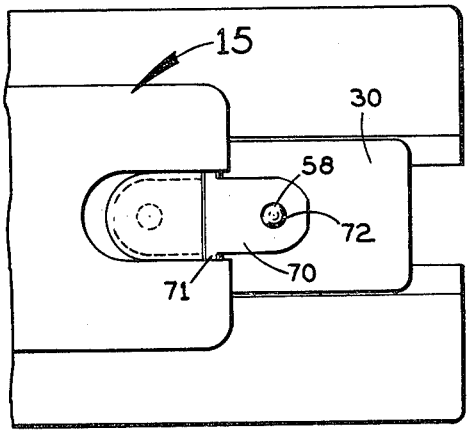
FIG. 12 is an enlarged fragmentary plan view taken along the line 12—12 in FIG. 10.

The motor 55 is carried by a mounting structure 60 which is detachably coupled to the base segment 15 and the hand grip 16*b* of the tool handle at the rear end of the tool (i.e., the end remote from handle segment 16*a*). The mounting structure 60 for the motor has a forwardly-extending projection 61 (FIG. 10) which is slidably received in a complementary recess 62 (FIGS. 1 and 11) formed in the rear end of a hand grip 16*b*. Projection 61 carries a catch plate 63 which presents a rearwardly-facing shoulder 64 (FIG. 10). The tool hand grip 16*b* carries a hingedly attached locking finger 65 (FIG. 1) with a transversely projecting nose 66 on its free end which engages the shoulder 64 to lock the motor mounting structure 60 in place when the parts are assembled as shown in FIG. 1. The locking finger 65 may be raised to the phantom line position in FIG. 1 to permit the motor mounting structure 60 to be detached. The motor mounting structure has a recess 67 (FIGS. 1 and 2) into which the user's forefinger may be inserted to engage the lip 66 on locking finger 65 and raise it to the release position shown in phantom in FIG. 1.

A long handle 60' with a switch for the power cord (not shown) for operating the motor is detachably connected to mounting structure 60 so that the whole assembly can be operated from a standing position, if desired.

Below the motor 55 in FIG. 10 the motor support structure has an extension 60*a* which carries two laterally spaced, forwardly projecting pins 68 which are slidably received in complementary recesses 69 (FIG. 11) formed in the base segment 15 of the abrading tool.

A locking plate 70 (FIG. 10) is pivotally mounted at 71 on the base segment 15 of the tool. This plate has an opening 72 for snugly receiving the cam follower on the holder 29 when the plate is pivoted from the full line position in FIG. 10 to the phantom line position. In the phantom line position in FIG. 10, the locking plate 70 prevents the holder 29, clamping plates 41 and 42, and abrading pad 49 from moving longitudinally with respect to the base of the tool. This is the position of the parts when the drive motor 55 is disconnected. When the drive motor is to be connected, the locking plate 70 is moved to the full line position in FIG. 10, permitting the cam follower 58 on holder 29 to be received in the drive cam groove 57 and permitting the holder 29, clamping plates 41 and 42, and abrading pad 49 to reciprocate as a unit back and forth lengthwise of the base of the tool when driven by motor 55 through the cam 56.

As shown in FIG. 7, the drive cam 56 at its front end is formed with a short axial extension 57*a* of its peripheral groove 57 which, when aligned with the cam follower 58 on holder 29, permits the cam to be slid axially over the cam follower to couple the drive motor 55 to the holder 29.

When the motor 55 is attached, it reciprocates the abrading pad 49 longitudinally of the tool base. The clamping plate projections 37, 38, 39 and 40 slide back and forth in the tool base recesses 33, 34, 35 and 36 the same distance as the cam follower 58 on holder 29 is displaced longitudinally of the tool by the drive cam 56.

When the motor 55 is detached, the locking plate 70 is positioned holding the holder 29 against movement with respect to the tool base. The tool may be moved back and forth manually to produce the desired abrading action of pad 49 on the grout between the tiles.

Figure 13:
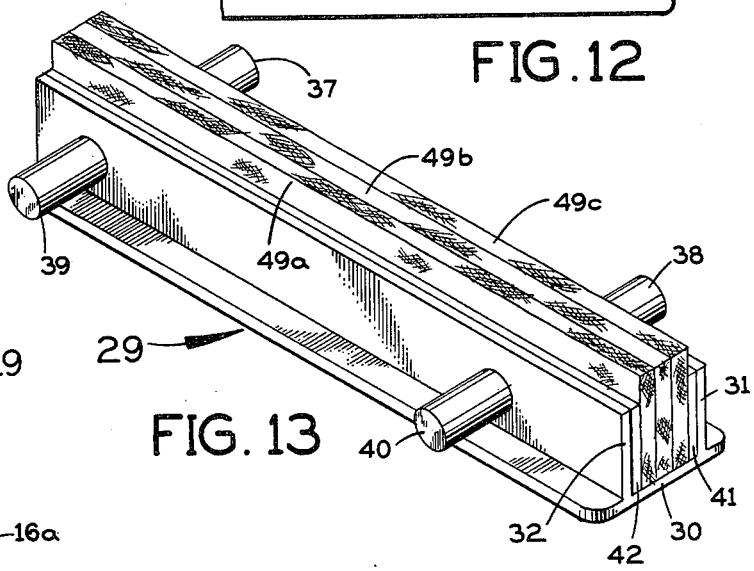
FIG. 13 is a perspective view showing three abrading pads clamped in a holder in the tool.

As shown in FIG. 13, for certain applications of the tool more than one abrading pad may be clamped in holder 29. For example, as shown there, three abrading pads 49a, 49b and 49c may be held between the opposed clamping plates 41 and 42 in the holder. Alternatively, two abrading pads may be put in the holder.

Figure 14:
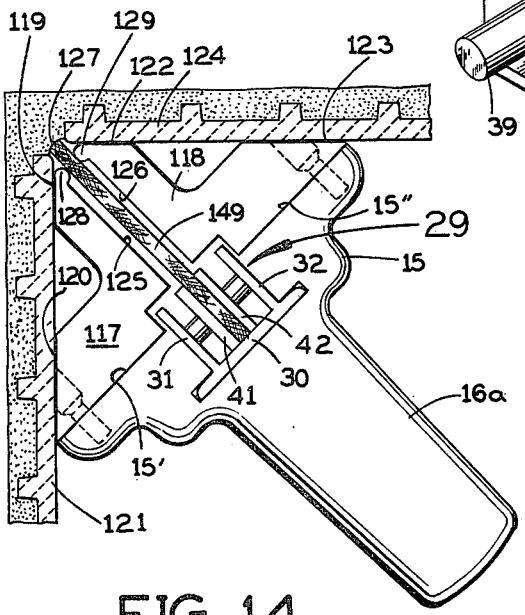
FIG. 14 is an end elevation of a modified version of the present tool having a special base for engaging the tiles at the corner of a wall.

FIG. 14 shows a modified construction of the present tool for use at a corner. The base plates 17 and 18 of FIG. 8 are replaced by base plates 117 and 118. Base plate 117 has two flat surfaces 119 and 120 for sliding engagement with the tile 121 at one side of this corner. Base plate 118 has similar flat surfaces 122 and 123 for sliding engagement with the tile 124 at the opposite side of this corner. The flats 119 and 120 on base plate 117 and the flats 122 and 123 on base plate 118 have the same angularity with respect to each other as the angularity of the corner tiles 121 and 124 with respect to each other. Usually, this will be perpendicular, as shown in FIG. 14. The base plates 117 and 118 present closely spaced, parallel, confronting inner faces 125 and 126. The abrasive pad 149, which is clamped between the clamping plates 41 and 42 in holder 29 in the manner already described, extends between these inner faces of the base plates and into engagement with the grout 127 at the corner between the tiles 121 and 124. Inwardly projecting rounded beads 128 and 129 on the inner faces of the base plates grip the abrasive pad 149 between them in close proximity to the grout 127 at the corner between the tiles.

I claim:

1. In an abrading tool having a base and a handle attached to said base and extending on one side of the base, said base having a longitudinal recess therein which is open at the opposite side of the base from said handle, the improvement which comprises:

a pair of rigid clamping members extending lengthwise in said recess in confronting relationship to one another, at least one of said clamping members being retractable away from the other clamping member;

and an abrasive pad sandwiched between said clamping members in said recess and projecting beyond said opposite side of the base for engagement with grout exposed between neighboring tiles in a tiled wall or floor;

a holder in said recess carrying said clamping members;

an electric motor mounted on said base and having a rotary shaft operatively coupled to said holder to reciprocate the latter in response to rotation of the shaft;

said handle being attached to the base at the front end of the abrading tool; and a mounting structure carrying the motor and releasably attached to the handle and the base at the opposite end of the abrading tool.

2. An abrading tool according to claim 1, and further comprising:

a cam on the motor shaft having a circumferentially and axially extending endless groove on its periphery;

and a cam follower on said holder slidably engaging in said groove to be reciprocated longitudinally of the base by rotation of said cam.

3. An abrading tool according to claim 2, and further comprising:

means for releasably mounting said motor on said base with its shaft operatively coupled to said holder through said cam and cam follower.

4. An abrading tool according to claim 2, and further comprising:

springs acting between said holder and said clamping members and biasing said clamping members toward each other in said recess in the base of the tool.

5. An abrading tool according to claim 1, and further comprising:

means for locking said holder against reciprocation along said base when said mounting structure for the motor is detached from the handle and base of the abrading tool.

6. An abrading tool according to claim 2, and further comprising:

a locking plate adjustably mounted on said base and having an opening which receives said cam follower to lock said holder against reciprocation along said base when said mounting structure for the motor is detached from the handle and base of the abrading tool, said locking plate being adjustable to a position disengaged from said cam follower to permit said cam to engage cam follower when said mounting structure for the motor is attached to the handle and base of the abrading tool.

7. An abrading tool according to claim 1, wherein:

said base includes a pair of base plates respectively located on opposite sides of said longitudinal recess and having exposed faces for sliding engagement with the tiles.

8. An abrading tool according to claim 7, wherein:

said exposed faces of the base plates are coplanar.

9. An abrading tool according to claim 7, wherein:

said exposed faces of the base plates extend transverse to each other for sliding engagement with the tiles on opposite sides of a corner.

10. In an abrading tool having a base and a handle attached to said base and extending on one side of the base, said base having a longitudinal recess therein which is open at the opposite side of the base from said handle, the improvement which comprises:

a pair of rigid clamping members extending lengthwise in said recess in confronting relationship to one another, at least one of said clamping members being retractable away from the other clamping member;

and an abrasive pad sandwiched between said clamping members in said recess and projecting beyond said opposite side of the base for engagement with grout exposed between neighboring tiles in a tiled wall or floor;

said base having transverse recesses extending laterally outward from said longitudinal recess on opposite sides of the latter, each of said transverse recesses being elongated longitudinally of the base;

and further comprising:

a holder in said longitudinal recess carrying said clamping members and having lateral projections slidably received in said transverse recesses in the base;

and a drive motor on said base operatively coupled to said holder to reciprocate the holder back and forth along said longitudinal recess;

said lateral projections on the holder being hollow and open at their laterally inward ends;

and further comprising:

transverse pins on said clamping members extending into said lateral projections on the holder;

and springs acting between said lateral projections on the holder and said transverse pins to bias said clamping members laterally inward toward each other.

11. In an abrading tool having a base and a handle attached to said base and extending on one side of the base, said base having a longitudinal recess therein which is open at the opposite side of the base from said handle, the improvement which comprises:

a pair of rigid clamping members extending lengthwise in said recess in confronting relationship to one another, at least one of said clamping members being retractable away from the other clamping member;

and an abrasive pad sandwiched between said clamping members in said recess and projecting beyond said opposite side of the base for engagement with grout exposed between neighboring tiles in a tiled wall or floor;

said handle being attached to the base at the front end of the abrading tool;

and fruther comprising:

a holder in said recess carrying said clamping means;

and locking means for selectively locking said holder against movement longitudinally of the base or releasing said holder for movement longitudinally of the base.

12. An abrading tool according to claim 11, and further comprising:

a drive motor;

and means for detachably mounting said motor on said base in driving engagement with said holder to reciprocate the latter longitudinally of the base.

* * * * *